United States Patent [19]

Holm

[11] Patent Number: 4,932,624

[45] Date of Patent: Jun. 12, 1990

[54] HOLDER FOR CONTAINERS TO HOLD LIQUID PRODUCTS

[76] Inventor: Harry Holm, Röläggarvägen 7, S-684 00 Munkfors, Sweden

[21] Appl. No.: 338,202

[22] Filed: Apr. 14, 1989

[30] Foreign Application Priority Data

Apr. 15, 1988 [SE] Sweden ..... 8801400

[51] Int. Cl.[5] ..... A47K 1/08

[52] U.S. Cl. ..... 248/311.3; 248/300

[58] Field of Search ..... 248/311.3, 311.2, 312, 248/300, 103, 248; 29/150; 222/181; 72/379

[56] References Cited

U.S. PATENT DOCUMENTS

| | | | |
|---|---|---|---|
| 1,571,000 | 1/1926 | Eustis | 248/300 X |
| 1,805,742 | 5/1931 | Reynolds | 248/300 X |
| 1,810,836 | 6/1931 | Laubenstein | 248/311.2 |
| 1,813,818 | 7/1931 | Reynolds | 248/300 X |
| 2,729,480 | 1/1956 | Berndt | 248/300 X |
| 2,921,761 | 1/1960 | Pine | 248/300 X |
| 3,872,868 | 3/1975 | Kline | 248/312 |

FOREIGN PATENT DOCUMENTS 418569 6/1981 Sweden .

*Primary Examiner*—Ramon S. Britts
*Assistant Examiner*—Daniel Hulseberg
*Attorney, Agent, or Firm*—Dennison, Meserole, Pollack & Scheiner

[57] ABSTRACT

Containers in the form of bags with a detachable, elongate sealing member (2) and pump (4) which is influenced by a lever (18 and 19), are applied in stationary holders manufactured from tubular material. The holder is simplified by manufacturing it from a rectangular plate (5) with a longitudinal slot (6), and the plate is then bent to form the holder.

3 Claims, 4 Drawing Sheets

HOLDER FOR CONTAINERS TO HOLD LIQUID PRODUCTS

BACKGROUND OF THE INVENTION

The present invention relates to a holder for containers to hold liquid products. Such containers may be in the nature of a bag having a sealing member attached or screwed on in conventional manner, said sealing member generally being in the form of a short cylinder and an opening nozzle. The cylinder itself contains a member for dosing the contents of the container. This member is influenced by a manual movement in the form of transverse pressure on a yielding portion in the sealing member. The dosing member generally consists of a pump means. The container may also be in the form of a bottle of arbitrary shape. A container of the type described is usually placed upside down with the sealing member facing downwards. The container with the sealing member is then usually placed in a holder with a movable lever which is then caused manually to influence the dosing member. Said holder was generally constructed from tubular material which can be easily and simply bent and welded to the desired shape. However, due to high labour costs, holders consisting of tubular material are relatively expensive and it is desirable to reduce the costs of the holders.

SUMMARY OF THE INVENTION

The object of the present invention is to produce a holder for containers of the type described above, which is considerably less expensive to produce than holders of tubular material. According to the invention this is achieved by using a rectangular plate provided longitudinally with a longitudinal slot. The plate is bent in the shape of a U in which the part on one side of the slot is bent inwards, thus forming a tubular passage for the cylindrical sealing member with dosing member. The sealing member is supported on two opposite sides by the bent plate and the dosing member is exposed by part of the plate being bent inwards. A lever is secured to the bent plate, a part of the lever being in contact with the yielding dosing member.

The holder according to the present invention may be provided with one or more simple, bent wires or rods of slimmer dimensions in order to steady the container itself. These wires or rods might also be replaced by a casing which is placed over the container and a part of the holder.

Additional features characteristic of the present invention are revealed in the following description.

BRIEF DESCRIPTION OF THE DRAWINGS

The invention will be described in more detail with reference to the accompany four sheets of drawings, in which.

DESCRIPTION OF THE PREFERRED EMBODIMENT

Figure 3:
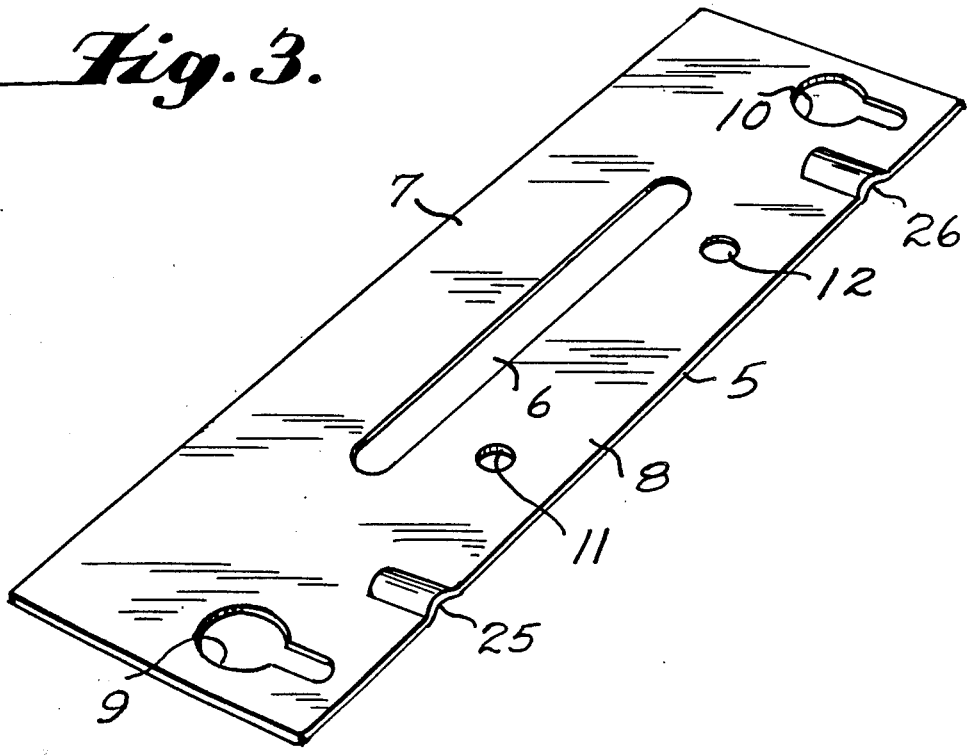
FIG. 3 shows a blank for manufacturing a holder.
Figure 4:
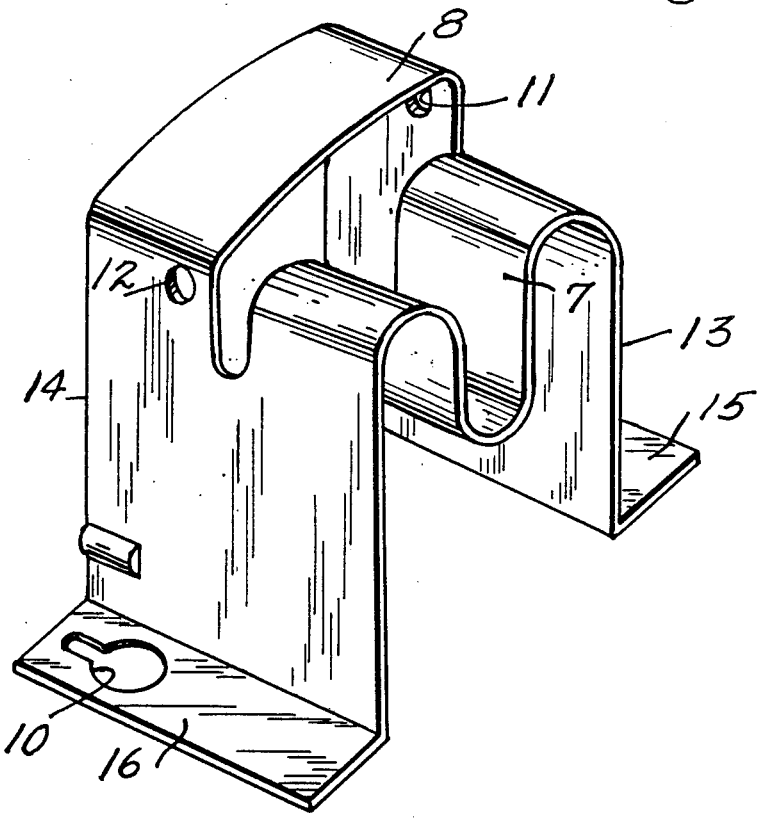
FIG. 4 shows a blank according to FIG. 3 which has been bent to form a holder.
Figure 5:
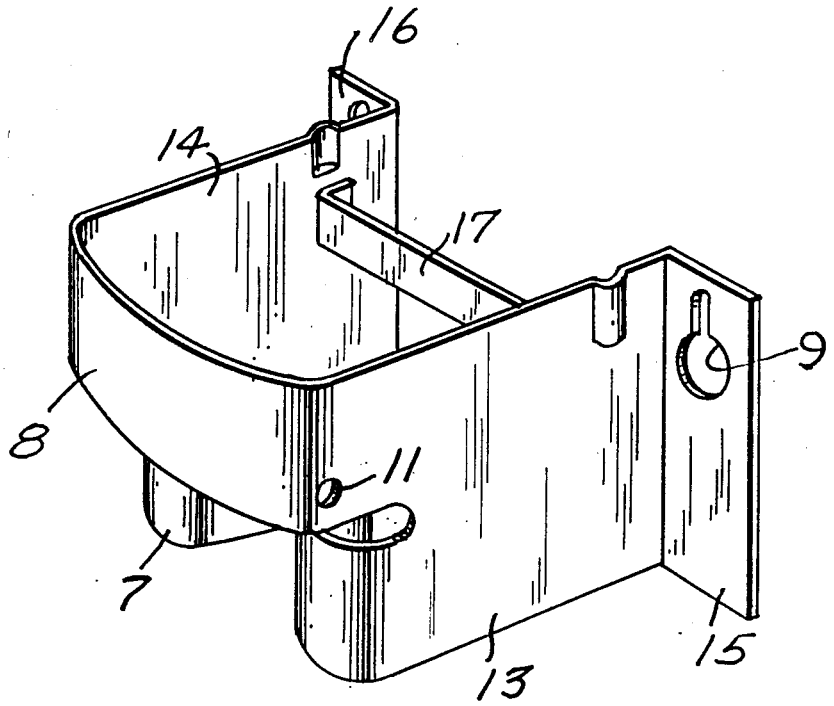
FIG. 5 shows the holder provided with a support strut.

In the drawings 1 is a plastic container in the form of a bag, turned upside down, and provided at its lower end with a sealing member 2. The sealing member 2 is provided with an emptying nozzle 3 and a dosing member 4 in the form of a pump. The container 1 rests in a holder shaped from a plate 5, as shown in FIG. 3. The plate 5 is rectangular and has a longitudinal slot 6. There are thus two parts 7 and 8, one on each side of the slot 6. The plate 5 is also provided with two recesses 9 and 10 enabling it to be secured to a wall. The plate 5 is also provided with two holes 11 and 12. The plate is bent in the manner shown in FIG. 4, so that the part 8 is bent outwards and is curved, whereas the part 7 is bent inwards and is thus also curved. The holes 11 and 12 will be located in two side portions 13 and 14. Two flanges 15 and 16 are also produced in the bending process, these encompassing the attachment recesses 9 and 10. The bent plate shown in FIG. 4 is also provided with a support strut, as shown in FIG. 5. The support strut is designated 17.

Figure 6:
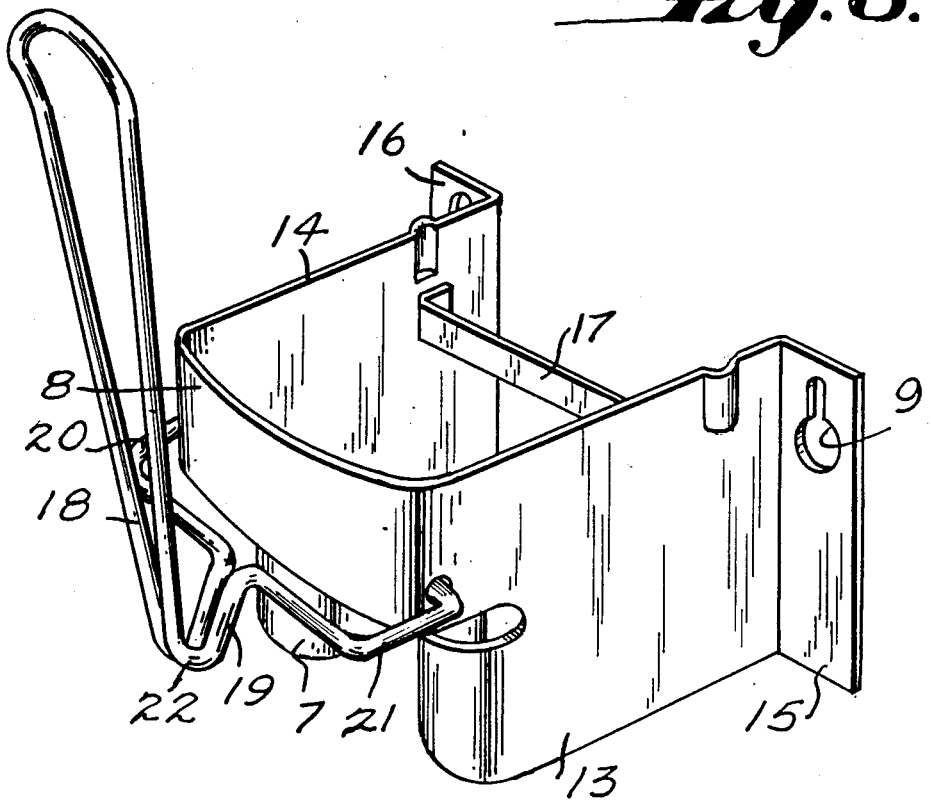
FIG. 6 shows the holder according to FIG. 5 provided with a lever with which to influence the dosing member.

The altered plate shown in FIG. 5 is then provided with a lever having two parts 18 and 19. The part 19 is divided into two arms 20 and 21, the ends of the arms being inserted into the holes 11 and 12 as is clearly visible in FIG. 6 and FIG 1. The lever is bent to produce a part 22 which will then cooperate with the dosing member 4.

Figure 1:
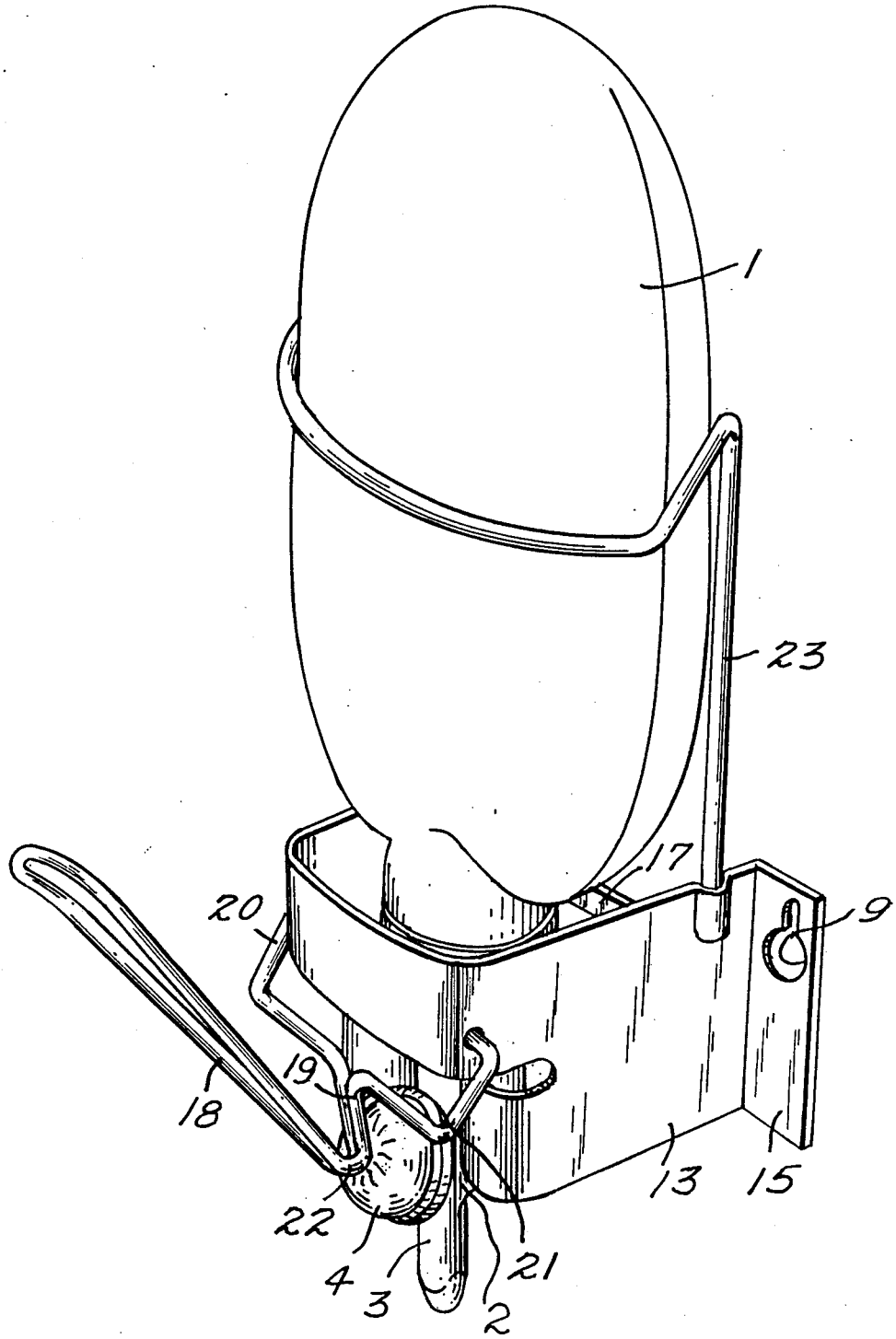
FIG. 1 shows a holder according to the present invention, together with a container provided with sealing member and dosing member.
Figure 2:
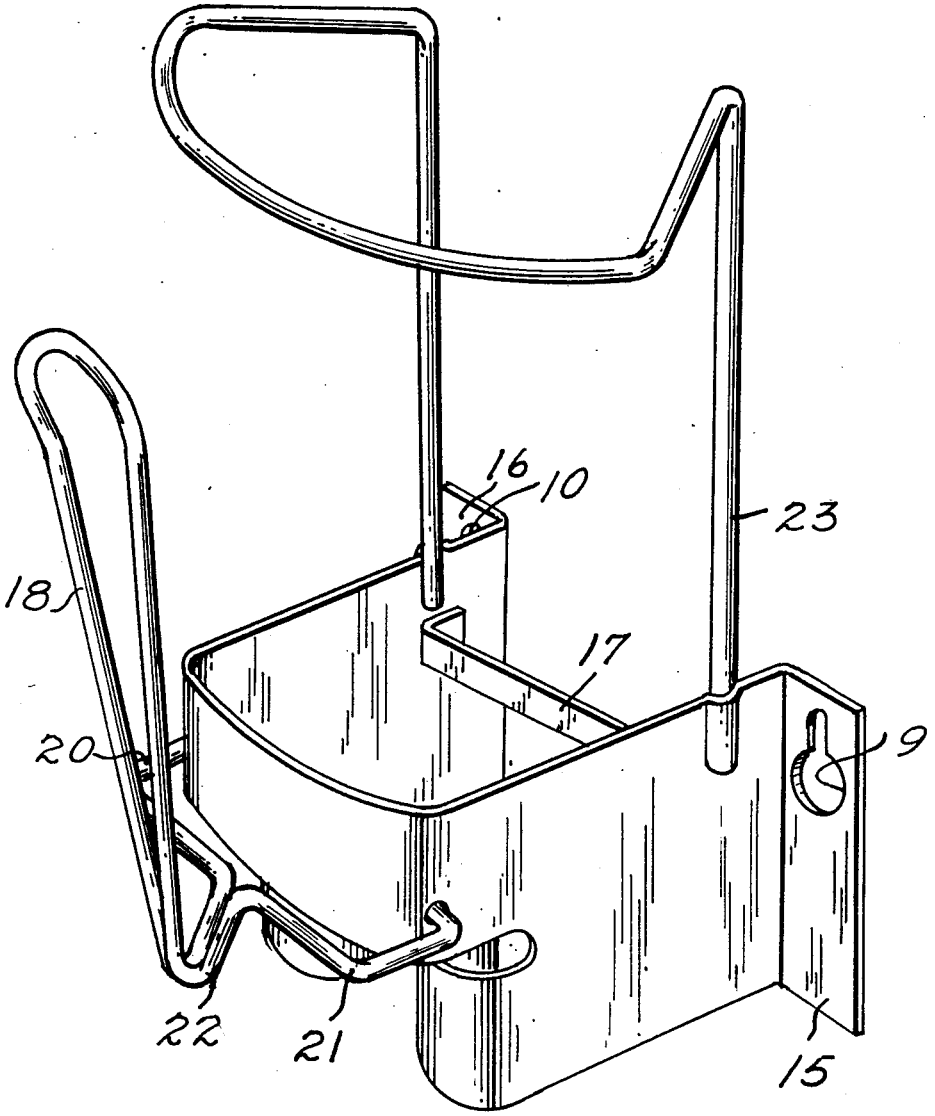
FIG. 2 shows the holder without container.

The container 1 in FIG. 1 is placed, as shown, in the holder consisting of parts of the plate 5 in FIG 3. When the container 1 is in place, the sealing member 2 will be located between the curved portions 7 and 8, these portions abutting the sealing member on two opposite sides and the dosing member is located in front of the inwardly bent part 7. When this has been done, the part 22 of the lever 18 and 19 will be in contact with the dosing member 4. If the lever 18 is now moved downwards, the part 22 will depress the outer portion of the dosing member 4, thus forcing a dose of liquid to leave the nozzle 3.

The strut 17, 23 formed by wire or thin rod material may be replaced by a casing which covers the container 1 and a part of the holder formed by the plate 5. The casing may then be provided with recesses 25, 26 allowing it to be attached by means of the same screws, hooks or nails which attach the holder formed by the plate 5. The casing may be provided at the top with a lockable lid so that when the liquid container is empty is can be lifted up and a full container be inserted in position as shown in FIG. 1.

It should be clear that the holder according to the present invention can also be used for bottles of various types which are provided with a seal with a dosing member.

I claim:

1. A holder for mounting a dispensing container on a vertical surface comprising a preformed generally rectangular plate including a plurality of preformed first and second pairs of apertures and at least one elongated uninterrupted slot extending through said plate, said slot being positioned generally along the longitudinal axis of said plate and terminating generally at a point equidistant from each end of said plate, said first pair of apertures constituting a pair of mounting apertures with each said mounting aperture positioned adjacent each end of said plate and displaced laterally outwardly from each end of said slot, said second pair of apertures being positioned on said plate between said slot and one edge of said plate, said plate being configured to define a generally U-shaped configuration including a pair of generally parallel leg portions each terminating in an oppositely directed flange and each said flange being dimensioned to include one of said first pair of mounting apertures, said U-shaped plate further including a bight and an inwardly directed support portion formed from that portion of said plate extending between said slot and the edge of said plate on the opposite side of said slot from said second pair of apertures, said bright and an inwardly directed support portion being configured to receive and support said dispensing container in a generally vertical position when said holder is mounted on said vertical surface, and a lever means operably attached to said second pair of apertures on said holder for actuating the dispensing container to selectively dispense the contents thereof.

2. The holder of claim 1, comprising a pair of preformed recesses, each positioned between said first and second pair of apertures, for receiving and supporting an auxiliary structure.

3. The holder of claim 2, wherein said auxiliary comprises structure a strut attached to said pair of recesses for embracing and supporting said dispensing container.

* * * * *

UNITED STATES PATENT AND TRADEMARK OFFICE

CERTIFICATE OF CORRECTION

PATENT NO. : 4,932,624

DATED : June 12, 1990

INVENTOR(S) : Harry Holm

It is certified that error appears in the above-identified patent and that said Letters Patent is hereby corrected as shown below:

Column 3, line 15, "bright" should read -- bight --

Signed and Sealed this

Twenty-fifth Day of June, 1991

*Attest:*

HARRY F. MANBECK, JR.

*Attesting Officer*

*Commissioner of Patents and Trademarks*